US007473020B2

(12) United States Patent
Pickering

(10) Patent No.: US 7,473,020 B2
(45) Date of Patent: Jan. 6, 2009

(54) LIGHT EMITTING DIODE DISPLAY SYSTEM

(76) Inventor: William Pickering, 202 Monitor St., Brooklyn, NY (US) 11222

( * ) Notice: Subject to any disclaimer, the term of this patent is extended or adjusted under 35 U.S.C. 154(b) by 368 days.

(21) Appl. No.: 11/483,026

(22) Filed: Jul. 7, 2006

(65) Prior Publication Data

US 2008/0007181 A1 Jan. 10, 2008

(51) Int. Cl.
*F21V 7/04* (2006.01)

(52) U.S. Cl. ..... 362/612; 362/252; 362/559

(58) Field of Classification Search . 315/169.11–169.3, 315/291; 362/251–252, 292–294, 611–612, 362/555, 559, 561; 349/150–151
See application file for complete search history.

(56) References Cited

U.S. PATENT DOCUMENTS

| | | | | |
|---|---|---|---|---|
| 3,862,360 | A * | 1/1975 | Dill et al. | 348/792 |
| 5,106,197 | A * | 4/1992 | Ohuchida et al. | 349/73 |
| 5,495,147 | A | 2/1996 | Lanzisera | |
| 6,011,599 | A * | 1/2000 | Akada et al. | 349/2 |
| 6,346,777 | B1 | 2/2002 | Kim | |
| 6,394,626 | B1 | 5/2002 | McColloch | |
| 6,461,019 | B1 | 10/2002 | Allen | |
| 6,676,284 | B1 | 1/2004 | Wynne | |
| 6,897,624 | B2 | 5/2005 | Lys | |
| 6,965,205 | B2 | 11/2005 | Piepgras | |
| 2004/0207341 | A1 | 10/2004 | Callahan | |
| 2004/0240890 | A1 | 12/2004 | Lys | |
| 2005/0017922 | A1 | 1/2005 | Devos | |
| 2005/0219171 | A1 | 10/2005 | Gimbutas | |
| 2005/0248299 | A1 | 11/2005 | Chemel | |
| 2005/0275626 | A1 | 12/2005 | Mueller | |
| 2005/0276053 | A1 | 12/2005 | Nortrup | |
| 2006/0002110 | A1 * | 1/2006 | Dowling et al. | 362/252 |

FOREIGN PATENT DOCUMENTS

| | | |
|---|---|---|
| DE | 40 20 807 | 1/1992 |
| JP | 2005 0584683 | 3/2005 |

OTHER PUBLICATIONS

"Grid-type LED Curtain" G-LEC for stage applications; Jun. 15, 2006; http://www.pro-music-news.com/html/studio/e41206gl.htm, Dec. 2004.

Barco Events; Belgian Barco Launches LED Display Platforms; Belgian Business Digest, Monday, Oct. 10, 2005.

U2 Vertigo Tour a feast fro the eyes with revolutionary Barco technology Barco events; Mar. 2005; http://www./barco.com/events/en/pressreleases/show.asp?index=1490.

* cited by examiner

*Primary Examiner*—David Hung Vu
*Assistant Examiner*—Tung X Le
(74) *Attorney, Agent, or Firm*—RatnerPrestia

(57) ABSTRACT

A light emitting diode (LED) display, including: drive circuitry; a control processor; a frame including two edges; multiple cables extending rigidly between the two edges of the frame; and at least one pixel module coupled to each cable. Each cable includes a power wire coupled to the drive circuitry, a ground wire, and at least one data bus wire coupled to the control circuitry. Each pixel module includes: a power electrode coupled to the power wire of the coupled cable; a ground electrode coupled to the ground wire of the coupled cable; a bus electrode coupled to the data bus wire of the coupled cable; an LED light source; and pixel control circuitry coupled to the electrodes and the LED light source. The pixel control circuitry is adapted to drive the LED light source with a drive current based on a control signal received from bus electrode.

35 Claims, 9 Drawing Sheets

300

LIGHT EMITTING DIODE DISPLAY SYSTEM

FIELD OF THE INVENTION

The present invention concerns the design of large-scale video displays using light emitting diodes (LED's). These displays may include dual sided video walls and multiple configurations.

BACKGROUND OF THE INVENTION

The increase in luminous power of LED's has led to a blurring of the distinction between architectural lighting, signage, and informational display systems. Traditional LED display systems have been built by arranging a matrix of LED's on rigid printed circuit panels. There is, however, a growing demand for LED display systems that consist of lightly suspended matrices of light sources without the heavy and opaque support structure associated with traditional LED display systems. These 'suspended' LED display systems may form a curtain-like display that is viewable from either side of the display plane. Examples of currently available products that may be used as the basis of such display systems include the MiSphere LED light source modules built by Barco, iColorFlex SL LED cable lights built by Color Kinetic, and GlasPlatz's PowerGlass. These three commercial products represent different approaches to the problem, but all have limitations, such as fixed pixel spacing in at least one direction. The artist Erwin Redl has also built a number of static LED artwork pieces that create a curtain of light.

The present invention facilitates the construction of large LED displays and offers some innovative features that may provide superior performance in many applications, particularly in fixed architectural displays.

SUMMARY OF THE INVENTION

An exemplary embodiment of the present invention is a light emitting diode (LED) display, including: drive circuitry to provide a drive current; a control processor to provide a control signal; a frame including a first edge and a second edge; a plurality of cables extending rigidly from the first edge of the frame to the second edge of the frame; and at least one pixel module coupled to each cable. Each cable includes a power wire electrically coupled to the drive circuitry to transmit a portion of the drive current, a ground wire, and at least one data bus wire coupled to the control circuitry to transmit at least a portion of the control signal. Each pixel module includes: a power electrode electrically coupled to the power wire of the coupled cable to receive a portion of the drive current transmitted by the coupled cable; a ground electrode electrically coupled to the ground wire of the coupled cable; a bus electrode electrically coupled to the data bus wire of the coupled cable to receive the portion of the control signal transmitted by the coupled cable; an LED light source; and pixel control circuitry electrically coupled to the power electrode, the ground electrode, the bus electrode, and the LED light source. The pixel control circuitry is adapted to drive the LED light source with the drive current based on the portion of the control signal received from bus electrode.

Another exemplary embodiment of the present invention is an LED display, including: drive circuitry to provide a drive current; a control processor to provide a control signal; a curved frame including an edge; a plurality of cables, each extending rigidly from one location on the edge of the curved frame to another location of the edge of the curved frame; and at least one pixel module moveably coupled to each cable. Each cable includes: a power wire electrically coupled to the drive circuitry to transmit a portion of the drive current; a ground wire; and at least one data bus wire coupled to the control circuitry to transmit at least a portion of the control signal. Each pixel module includes: a power electrode electrically coupled to the power wire of the coupled cable to receive a portion of the drive current transmitted by the coupled cable; a ground electrode electrically coupled to the ground wire of the coupled cable; a bus electrode electrically coupled to the data bus wire of the coupled cable to receive the portion of the control signal transmitted by the coupled cable; an LED light source; and pixel control circuitry electrically coupled to the power electrode, the ground electrode, the bus electrode, and the LED light source. The pixel control circuitry is adapted to drive the LED light source with the drive current based on the portion of the control signal received from bus electrode.

An additional exemplary embodiment of the present invention is a pixel module for a two sided LED display, including: a rigid, thermally conductive substrate having a front face, a back face substantially opposite the front face, and a side face substantially perpendicular to the front face and the back face and extending between the front face and the back face; a flexible printed circuit board (FPCB) laminated on the front face, the back face, and the side face of the rigid, thermally conductive substrate; a power electrode mounted on a side portion of the FPCB corresponding to the side face of the rigid, thermally conductive substrate; a ground electrode mounted on the side portion of the FPCB; a bus electrode mounted on the side portion of the FPCB; a first LED light source mounted on a front portion of the FPCB corresponding to the front face of the rigid, thermally conductive substrate; a second LED light source mounted on a back portion of the FPCB corresponding to the back face of the rigid, thermally conductive substrate; and pixel control circuitry mounted on the FPCB. The FPCB is laminated onto the rigid, thermally conductive substrate such that the FPCB is thermally and mechanically coupled to the rigid, thermally conductive substrate and the FPCB is not electrically coupled to the rigid, thermally conductive substrate. The power electrode is adapted to receive a drive current and the bus electrode is adapted to receive a control signal. The pixel control circuitry is electrically coupled to the power electrode, the ground electrode, the bus electrode, the first LED light source, and the second LED light source. The pixel control circuitry is also adapted to drive the first LED light source and the second LED light source with the drive current based on the control signal received from bus electrode.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features are arbitrarily expanded or reduced for clarity. Included in the drawing are the following figures.

DETAILED DESCRIPTION OF THE INVENTION

Exemplary embodiments of the present invention include light emitting diode (LED) display systems that permit construction of strands of display pixels with arbitrary spacings. Additionally, exemplary embodiments include a clamp-on design for pixel modules that may permit simplified repair, replacement, and adjustment of the pixel modules.

Because the bus wires of exemplary embodiments of the present invention are held in tension, accurate alignment of the pixel modules in the display matrix may be achieved.

Figures 1A, 1B:
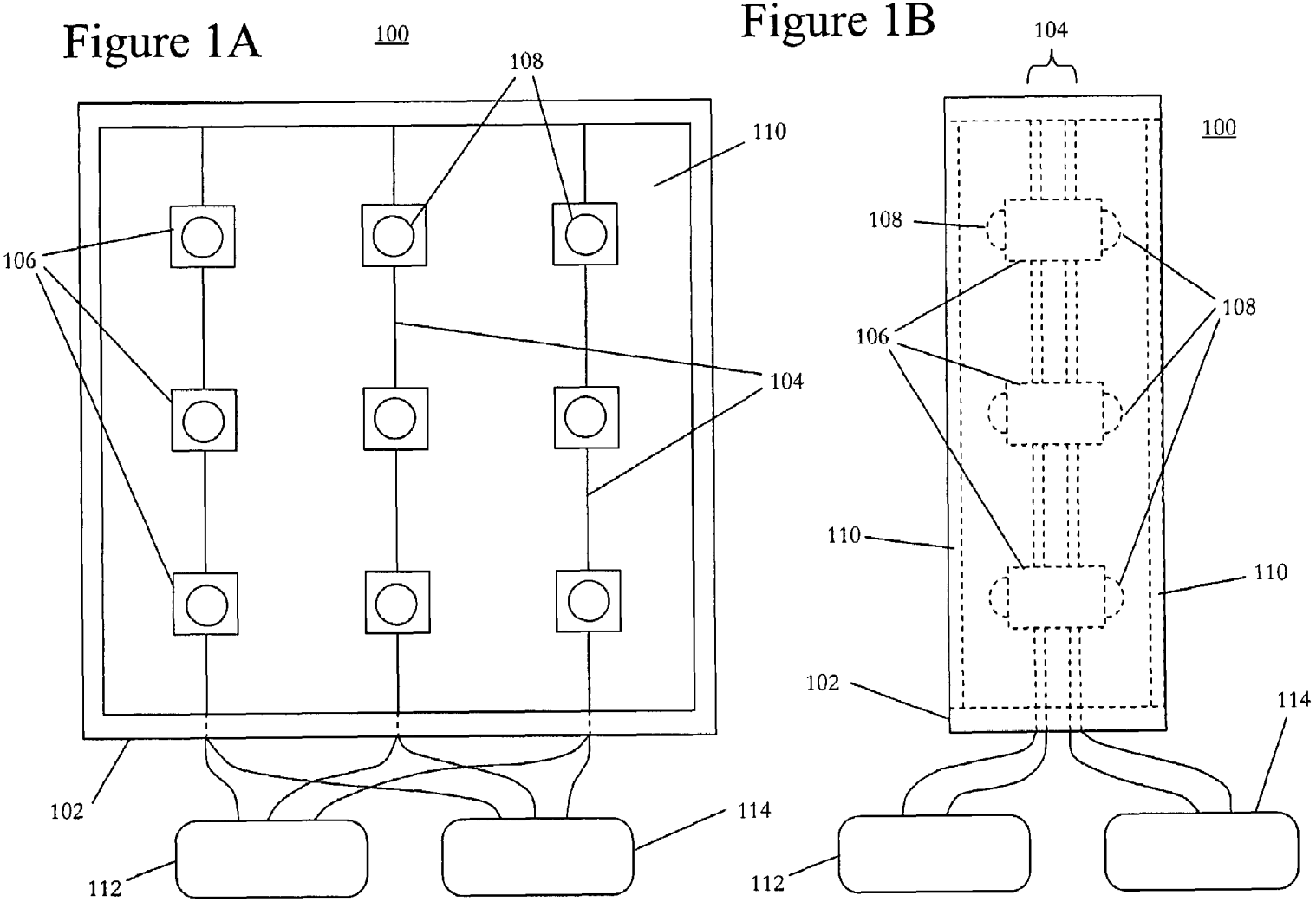
FIG. 1A is a front plan drawing of an exemplary light emitting diode (LED) display according to the present invention.
FIG. 1B is a side plan drawing of the exemplary LED display of FIG. 1A.
Figure 6A:
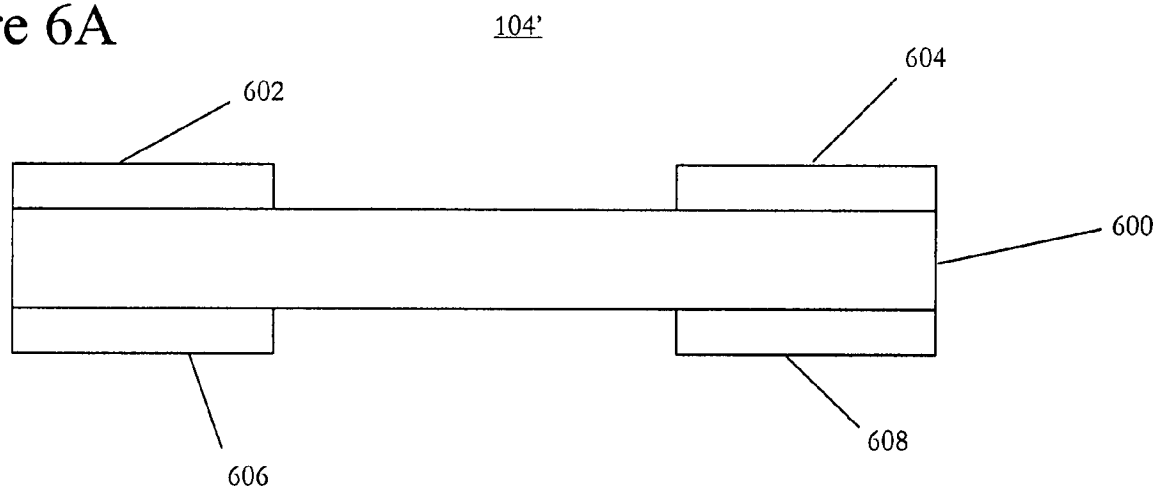
FIG. 6A is an end plan drawing of an exemplary ribbon cable that may be used in exemplary LED displays according to the present invention.
Figure 6B:
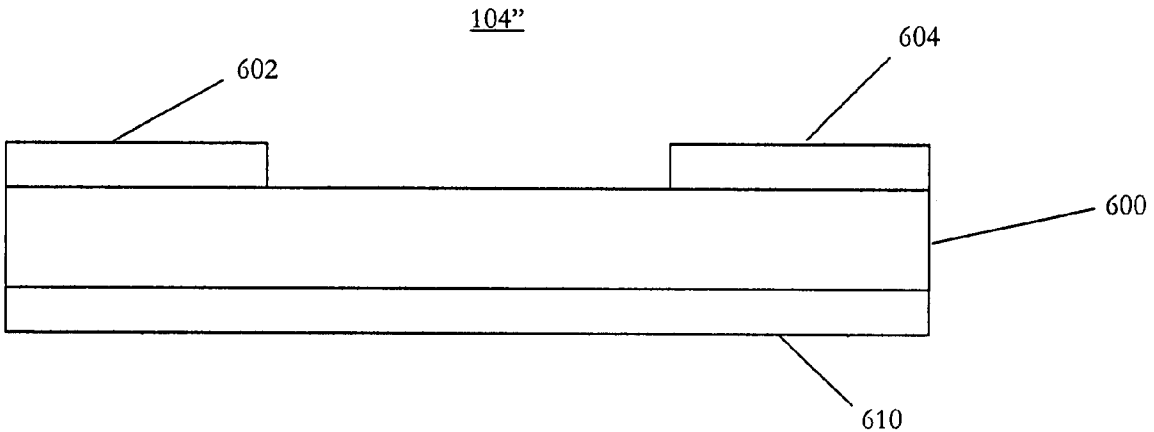
FIG. 6B is an end plan drawing of another exemplary ribbon cable that may be used in exemplary LED displays according to the present invention.

FIGS. 1A and 1B illustrate exemplary LED display 100. This exemplary display system includes a matrix of individual LED pixel modules 106 that are attached to cables 104. These cables may be formed by several strands of tensioned wire strung between opposite sides of frame 102, as shown in FIGS. 1A and 1B. FIGS. 6A and 6B illustrate alternative ribbon based cables 104' and 104".

Frame 102 desirably surrounds and defines the display surface(s) of exemplary display system 100. It is contemplated that frame 102 may include only a top edge, possibly mounted to the ceiling, and a bottom edge, possibly mounted to the floor, in some architectural implementations. In these alternative embodiments, frame 102 may still define the display surface(s) without fully surrounding it. Exemplary display system 100 includes a front display surface and a back display surface, however one skill in the art will understand that the exemplary features of the present invention may also be used in LED display systems that have only one display surface.

Figure 8:
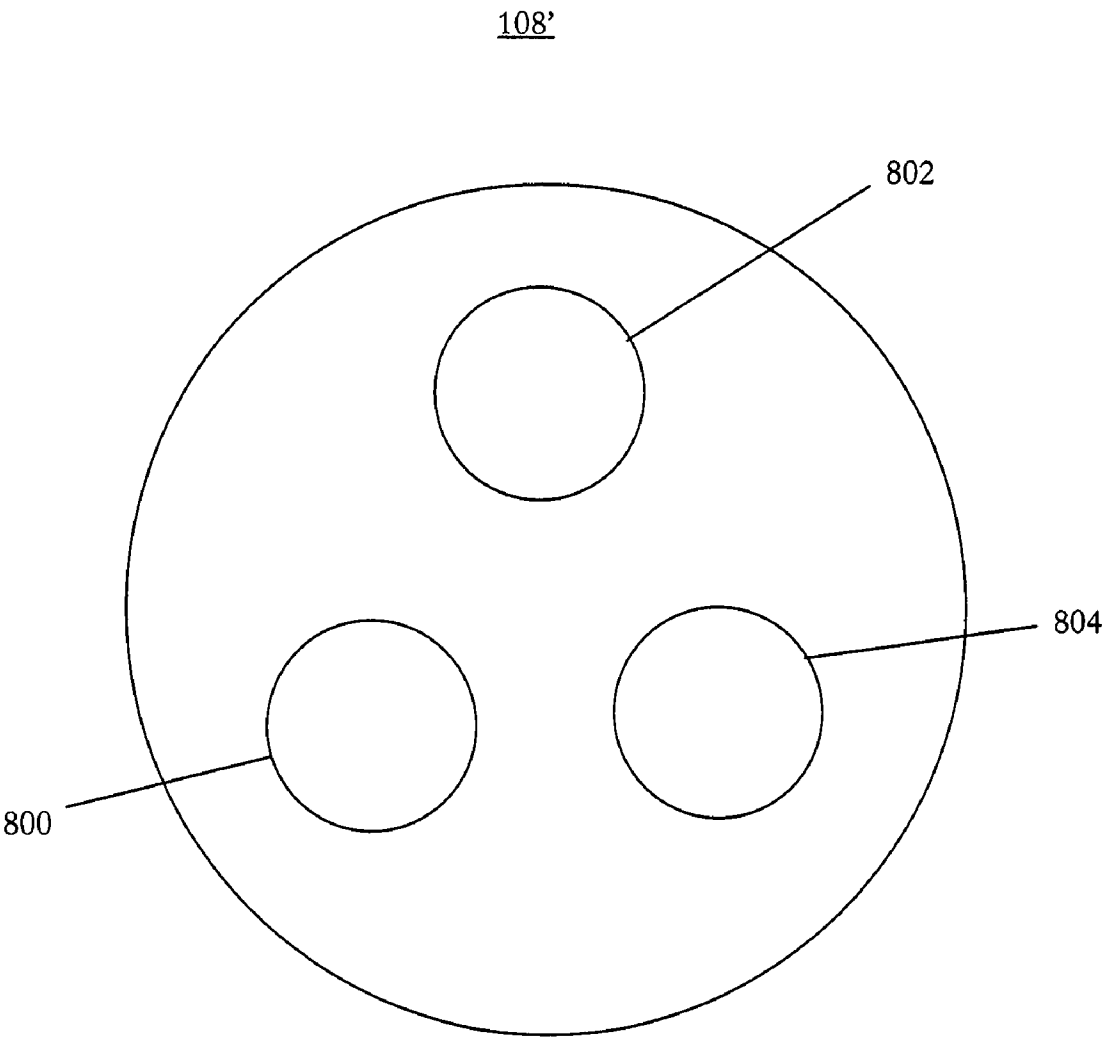
FIG. 8 is a front plan drawing of an exemplary RBG LED light source may be used in exemplary pixel modules according to the present invention.

Frame 102 may desirably include face plate(s) 110 mounted coincident with the display surface(s). Face place(s) 110 may be transparent or translucent. Transparent face plates may allow for brighter displays by transmitting a greater amount of light from LED light sources 108, while translucent face plates may provide for more uniform imaging from the display by increasing the apparent size of each light source. This blurring of the transmitted light may be particularly advantageous for color displays in which each LED light source 108 includes separate red, blue, and green LED's to produce various colors. FIG. 8 illustrates exemplary RBG LED light source 108' with red LED 800, blue LED 802, and green LED 804. Face place(s) 110 may be formed of a solid material, such as: glass; acrylic; polycarbonate; polypropylene; polyester; or other optical materials, or may be permeable, similar to a cloth projection screen. Solid faceplates may provide improved environmental protection and/or structural support, while permeable faceplates may allow for superior heat management.

Figure 2B:
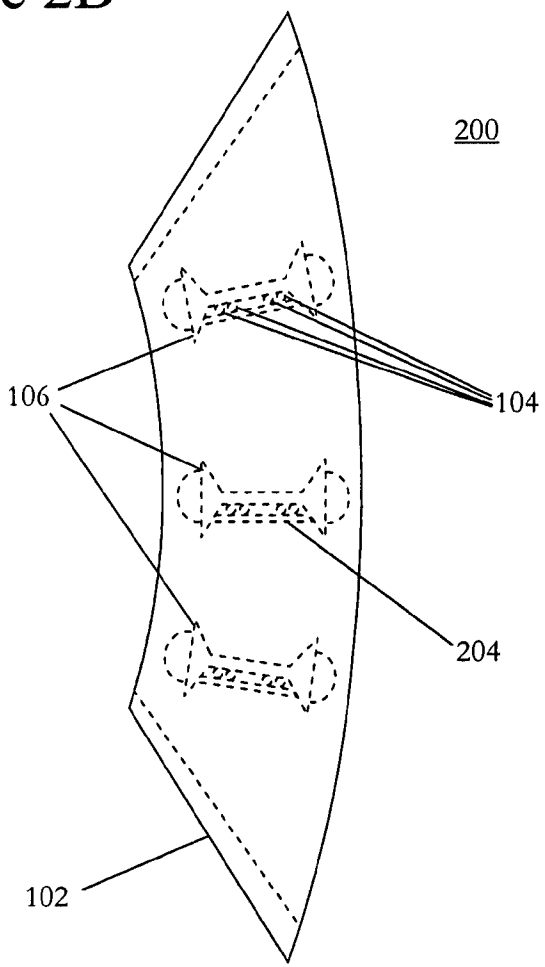
FIG. 2B is a top plan drawing of the exemplary LED display of FIG. 2A.
Figure 2A:
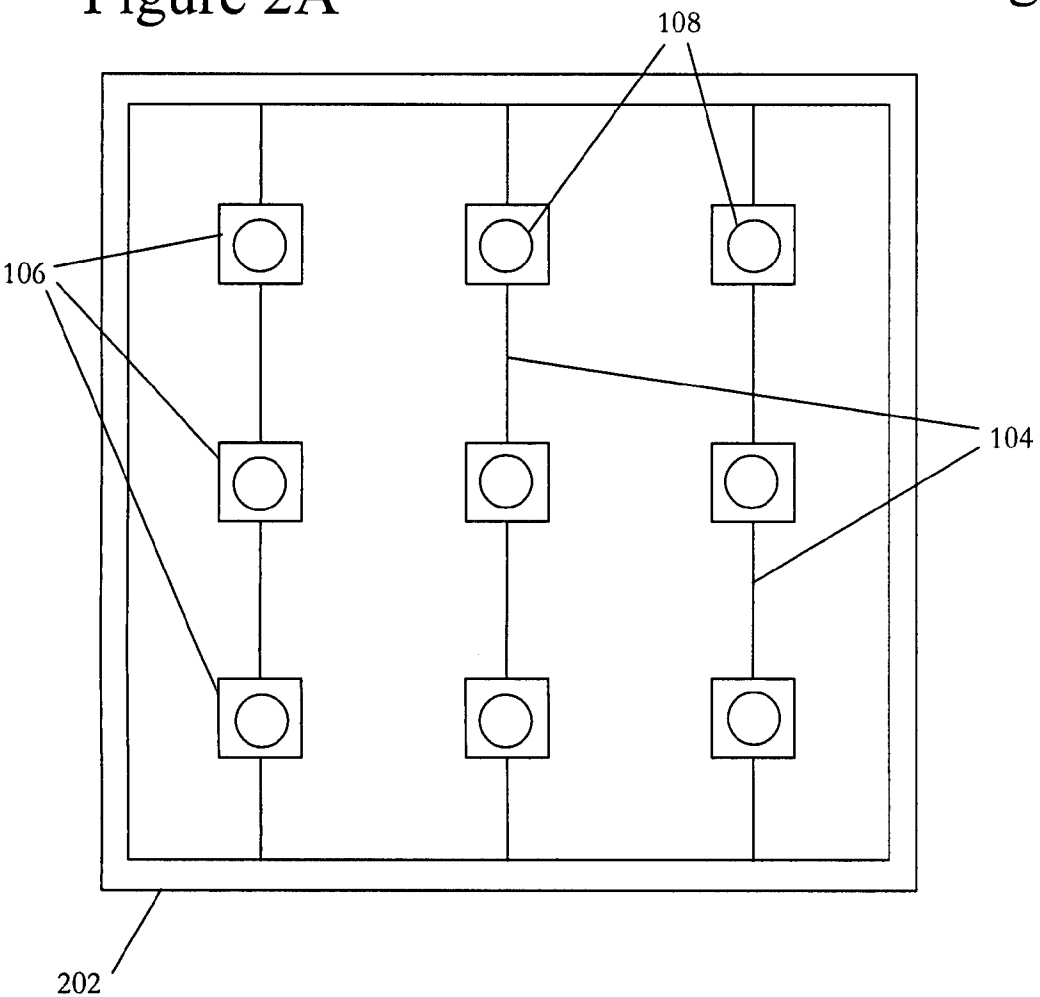
FIG. 2A is a front plan drawing of another exemplary LED display according to the present invention.

The display surface defined by frame 102 may typically be a planar display surface as shown in FIG. 1B, however, it is contemplated that a curved display surface may be formed as well. For example, FIGS. 2A and 2B illustrate exemplary curved LED display 200. Each cable 104 is still strung straight between two edges of the frame 202, but the top and bottom edges of frame 202 are curved so that a concave and a convex display surface are formed. It is contemplated that other LED display systems with nonplanar display surfaces may be designed in which the edges of the frame are curved, straight, or both. For example, in an exemplary frame with straight top and bottom edges between which the cables are strung, if the top edge of a frame is skew to the bottom edge of the frame instead of parallel or intersecting, the resulting display surface(s) are curved.

Figure 3:
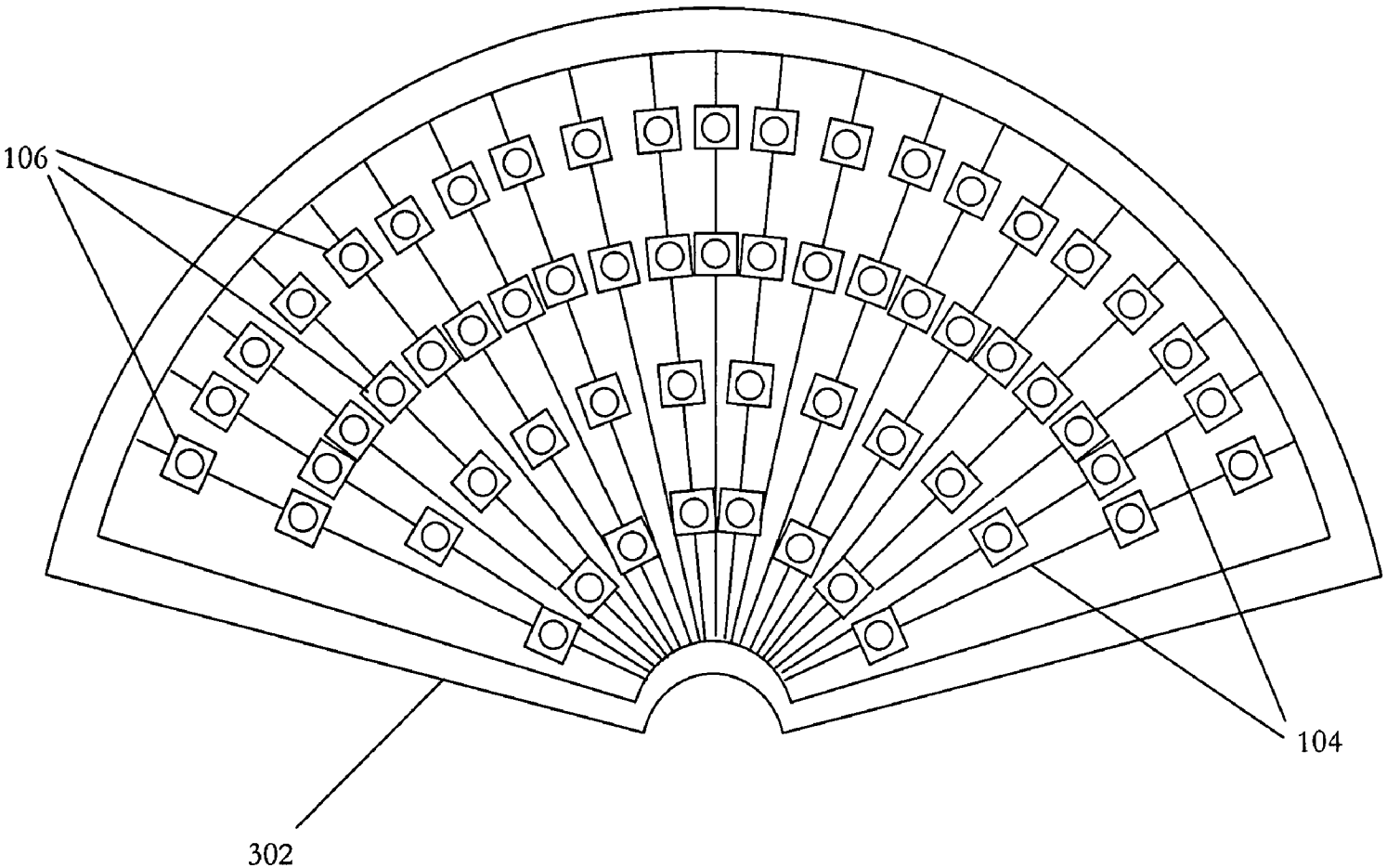
FIG. 3 is a front plan drawing of a further exemplary LED display according to the present invention.

FIG. 3 illustrates alternative exemplary LED display 300 in which cables 104 are strung between two curved edges of frame 302 that are curved, but unlike exemplary LED display 200, the display surface(s) of LED display 300 are planar. It is noted that cables 104 are not parallel in LED display 300, unlike both exemplary LED displays 100 and 200, discussed above. Also shown in FIG. 3, the structure of exemplary display systems of the present invention allows pixel modules 106 to be spaced along cables 104 so as to provide a desired density. The pixel modules in the smallest radius are spaced to be mounted on every third cable, those in the second smallest radius are mounted on every other cable, and those in the outer two radii are mounted on every cable.

Figure 4:
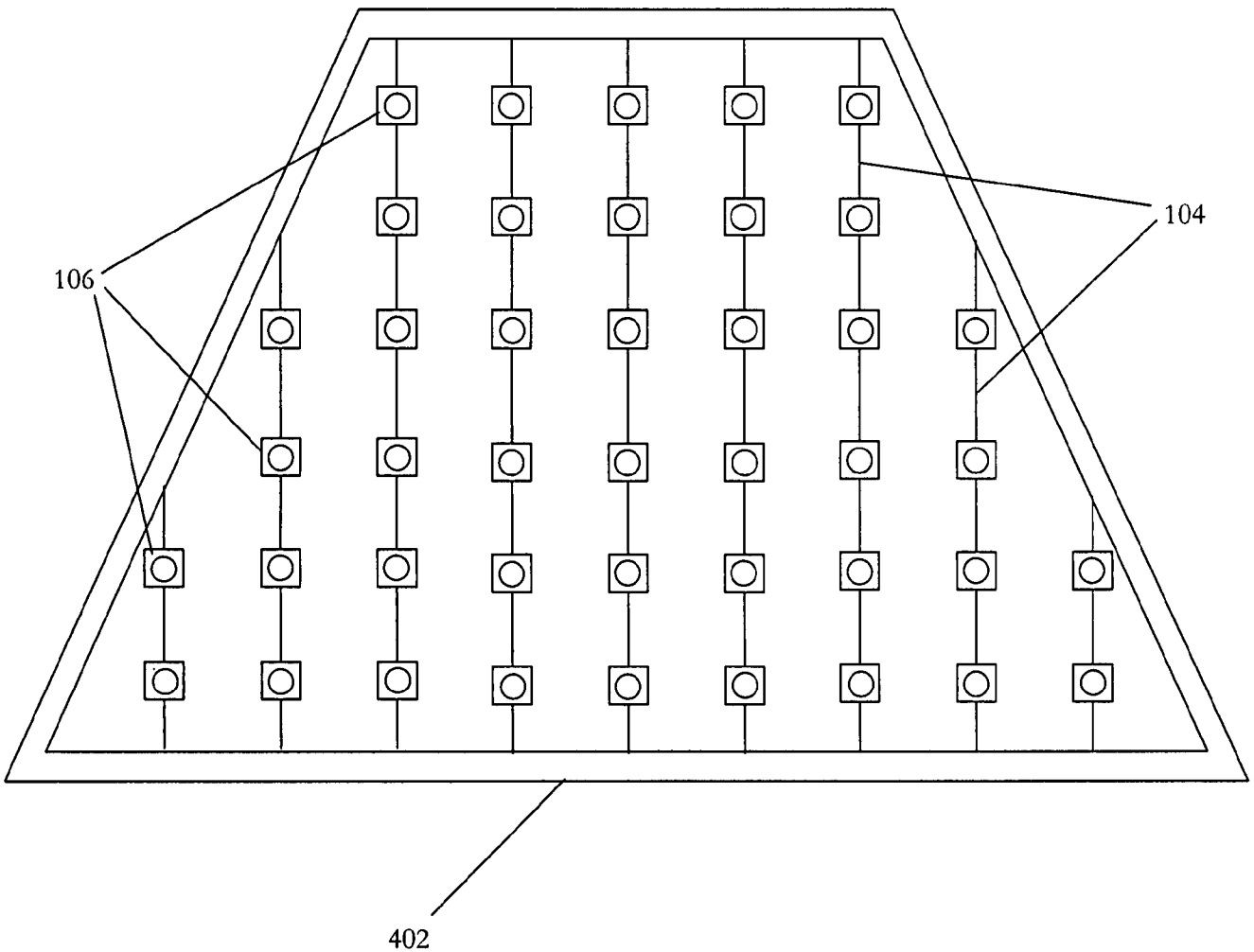
FIG. 4 is a front plan drawing of an alternative exemplary LED display according to the present invention.

FIG. 4 illustrates exemplary LED display 400 with trapezoidal frame 402. As shown in FIG. 4, it is contemplated that cables 104 may be strung between more than just two opposing edges of the frame in exemplary embodiment of the present invention. Additionally, it is noted that some of cables 104 in exemplary LED display 400 have different lengths, unlike the cables in exemplary LED displays 100, 200, and 300, discussed above.

Figure 5:
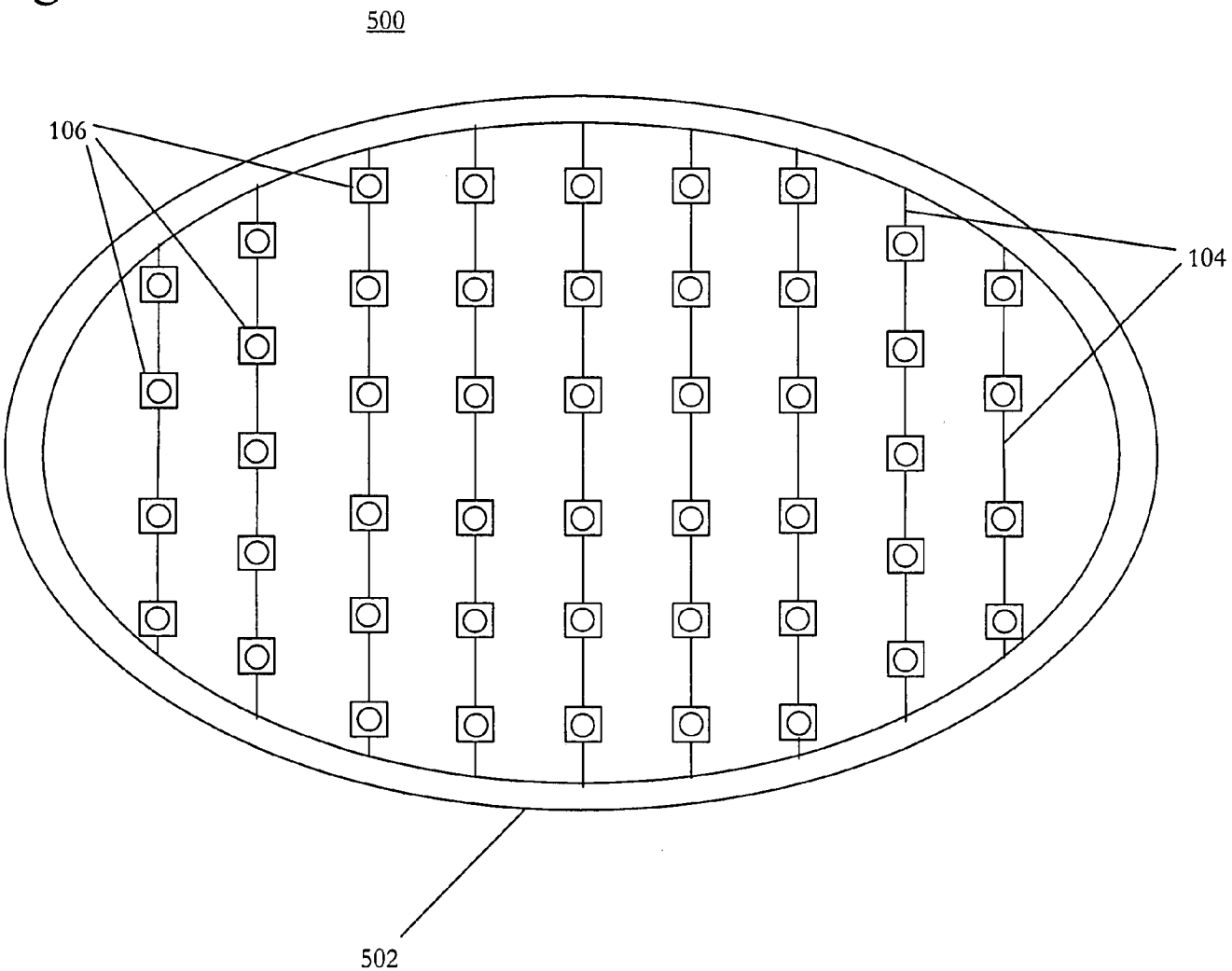
FIG. 5 is a front plan drawing of an additional exemplary LED display according to the present invention.

FIG. 5 illustrates exemplary LED display 500 that includes curved frame 502, which has a single curved edge. In this exemplary embodiment, cables 104 necessarily extend rigidly from one location on the single curved edge of curved frame 502 to another location of the single curved edge of the frame. It is noted that, although exemplary curved frame 502 has a single edge that forms a closed curve, other configurations in which at least some of the cables are strung between two locations of the same curved edge are contemplated.

It is noted that the exemplary displays systems illustrated in FIGS. 1A-C, 2A, 2B, 3, 4, and 5 are merely illustrative and are not intended to be limiting. One skilled in the art will appreciate that the various features of the frame and cable structure of the present invention illustrated in exemplary LED displays 100, 200, 300, 400, and 500 allow for exemplary embodiments of the present invention to be used to accomplish a multitude of display solutions for various geometries and effects beyond those explicitly illustrated.

Additionally, frame 102 of the display system may desirably contain drive circuitry 112 to provide a drive current to pixel modules 106 and control processor 114 to provide a control signal to pixel modules 106. Alternatively, drive circuitry 112 and control processor 114 may be, wholly or partially, housed separately and coupled to the rest of the display system by standard transmission lines. Drive circuitry 112 and control processor 114 may be connected to the wires of cables 104 using terminal/tensioning blocks which have adjusting screws to correctly tension the individual wires of the cables, or the ribbon in the case of ribbon based cables. These terminal/tensioning blocks may desirably include machined or molded plastic units with four sliding metal contacts. These contacts ride in guide slots in the terminal/tensioning block body and their position in the block may be adjusted by four socket cap screws. The wires of each cable pass through guide holes in the plastic terminal/tensioning block body.

Control processor 114 may include a general-purpose computer, a digital signal processor, a digital video interface, special purpose video control circuitry, an application specific integrated circuit, or a combination of these components.

Returning to FIGS. 1A and 1B, cables 104 may desirably be arranged in evenly spaced, parallel columns between rigid frame elements, however, as noted with reference to FIG. 3, this is not necessary. The wires in each cable include a power wire, a ground wire, and at least one data bus wire. The power wire is electrically coupled to the drive circuitry to transmit the drive current to the pixel modules. The data bus wire is electrically coupled to the control circuitry to transmit the control signal to the pixel modules. It is noted that the control circuitry may provide only a portion of the control signal to each cable (i.e. only the portion of the signal for the pixel modules coupled to that cable). The ground wire may provide a ground for both the drive power and the data signal. Other wires, such as a bus ground wire or one or more wires to provide added mechanical stability, may be included.

FIGS. 1B and 2B both illustrate cables 104 as four separate wires including a power wire, a ground wire, a data bus wire, and either a bus ground wire or a mechanical support wire. The wires in each cable are desirably parallel and may be placed in a plane normal to the display surface as shown in FIGS. 1A, 1B, 2A, and 2B. In this configuration, as seen from the front of the display surface, the four wires may appear as one thin line. This configuration is also useful to align the pixel modules and prevent them from twisting.

The power wire, ground wire, and data bus wire(s) are desirably formed of an electrically conductive material with sufficient mechanical strength to hold pixel modules 106 rigidly in place, although less mechanically strong wires may be used if used in conjunction with one or more mechanical support wires. For example, metallic wires, such as: copper; aluminum; nickel; brass; etc., may desirably be used for the power wire, ground wire, and data bus wire(s). The wires may additionally be gold plated to prevent corrosion and ensure good electrical contact with the electrodes of the pixel modules. The wire may also desirably be thermally conductive to assist in dissipating heat generated by the pixel modules. The desired wire sizes may be selected based on the operating current, mechanical strength, and/or heat management needs of the pixel modules as well as the number of modules to be coupled to each cable.

Mechanical support wires may be formed of an inherently stiff material or may formed of material that only becomes rigid under tension, e.g. nylon line.

The power wire, ground wire, and data bus wire(s) may desirably be left bare. However, in some applications it may be desirable for one or more of these wires to be insulated. In these applications the wire(s) may be surrounded by an electrically insulating layer, which may be selectively stripped at predetermined intervals for the pixel modules to be attached. Alternatively, at least one corresponding power electrode, ground electrode, or data bus electrode of each pixel module may be adapted to pierce the electrically insulating layer surrounding the insulated wire(s) to which the pixel module is coupled. It is also contemplated that the finished cable/pixel module assembly may be coated with a sprayed on, clear conformal insulation.

FIGS. 6A and 6B illustrate two exemplary cable designs in which power wire 602 and data bus wire 604 are mechanically coupled to on side of electrically insulating ribbon 600 and the ground wire(s) are mechanically coupled to the other side of ribbon 600. FIG. 6A illustrates exemplary dual ground ribbon cable 104' with power ground wire 606 and bus ground wire 608 and FIG. 6B illustrates exemplary single ground ribbon cable 104" with ground wire 610. It is noted that the two configurations shown in FIGS. 6A and 6B are merely illustrative and that other configurations, including configurations with all of the wires on the same side to the ribbon, may be used as well. The ribbon configuration has the advantage of separating the electrical conductivity and mechanical strength features of cables 104 between the wires and ribbon 600, respectively. This allows the wires to be formed of less mechanically strong materials, such as gold or organic conductors. Ribbon 600 may be formed of any electrically insulating material that has sufficient mechanical strength when under tension. The wires may be mechanically coupled to ribbon 600 by an adhesive or they may desirably be formed directly on ribbon 600 by processes such as deposition, evaporation, or printing.

Figure 1C:
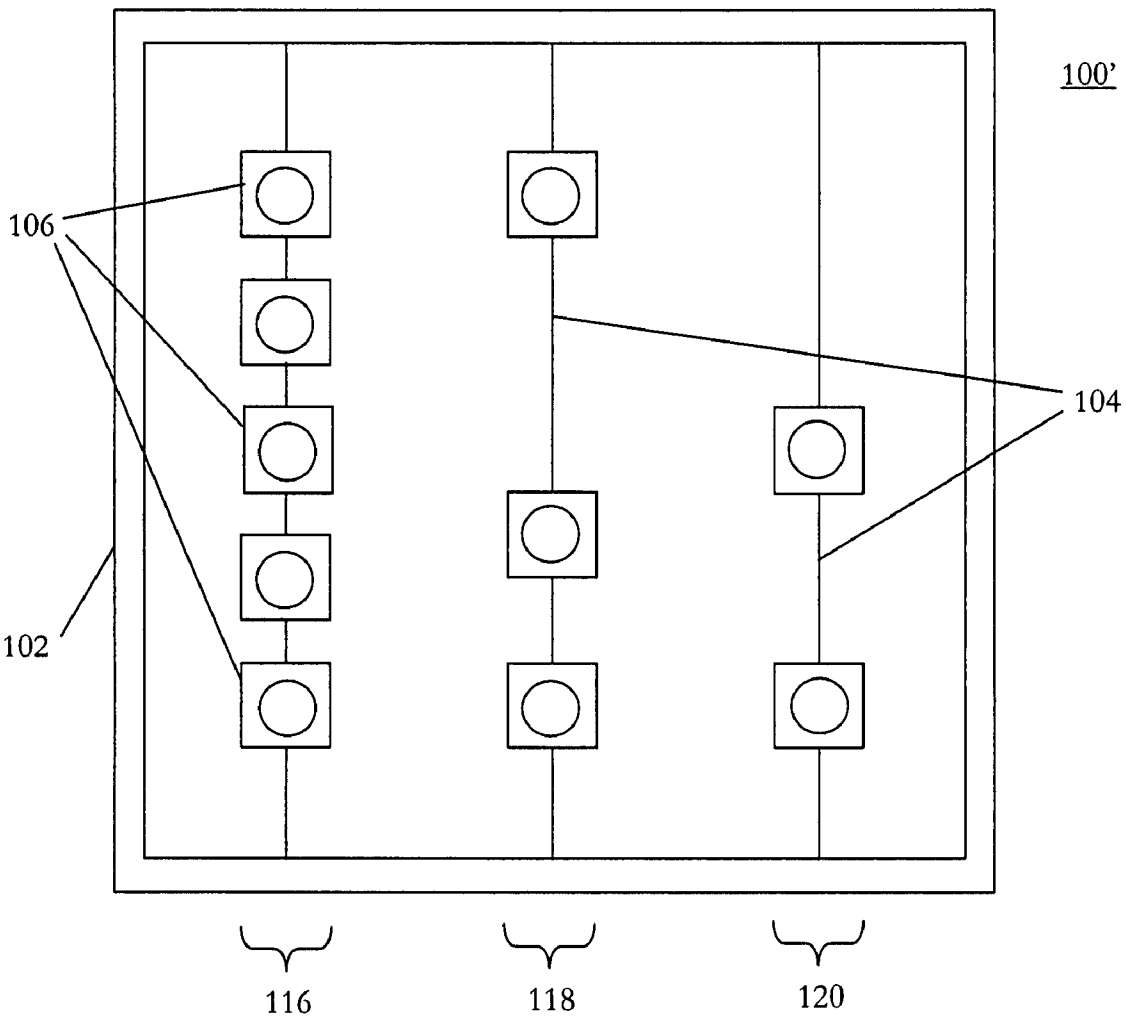
FIG. 1C is a front plan drawing of the exemplary LED display of FIG. 1A illustrating three alternative configurations of exemplary pixel modules on cables of the exemplary LED display according to the present invention.

As shown in FIGS. 1A-C, 2A, 2B, 3, 4, and 5, at least one pixel module 106 may be coupled to each cable 104. FIGS. 1A and 1B illustrate exemplary LED display 100 in which three pixel modules 106 are coupled to each of three cables 104 to form a substantially square 3×3 matrix of pixels. FIG. 1C illustrates alternative LED display system 100', which demonstrates several ways in which pixel modules may be rearranged in the exemplary LED display systems of the present invention. In column 116, two pixel modules have been added to the corresponding column from exemplary display 100. Column 118 has been changed from the corresponding column of exemplary display 100 by sliding one of the pixel modules to a new location along cable 104. In column 120, a pixel module has been removed from the corresponding column from exemplary display 100.

Each pixel module 106 includes at least: a power electrode; a ground electrode; at least one bus electrode; an LED light source; and pixel control circuitry. Exemplary pixel modules may also desirably include a rigid, thermally conductive substrate and a flexible printed circuit board (FPCB) laminated to the rigid, thermally conductive substrate such that the FPCB is thermally and mechanically, but not electrically coupled to the substrate. The construction of these pixel modules allows the use of high output LED devices with thermally enhanced packaging.

The rigid, thermally conductive substrate may desirably be formed of at least one of aluminum, brass, bronze, or copper, and may be stamped, die cast or slide formed. This substrate may act as a heatsink to dissipate excess heat generated by the LED light source(s) and the pixel control circuitry. It provides the shape for the pixel module and arranges the various components of the pixel module so the LED light source(s) are perpendicular to the cable wire plane and are centered in this wire plane.

The use of an FPCB allows the electronic components of a pixel monitor to be fabricated, assembled and tested in flat panels with standard surface mount technology assembly equipment. The electrodes, LED light source(s), and pixel control circuitry are all desirably coupled to the FPCB. Then the FPCB may be shaped to fit the substrate profile. Because flex circuitry has good thermal conductivity, high-powered LED light sources may be used and the excess heat is transferred to the substrate. An exemplary FPCB is a two-layer board with a maximum overall thickness of 8 mils and was manufactured according to the IPC 6013 standard. The FPCB may desirably be bonded to the substrate using a thermally conductive, pressure sensitive adhesive film. Such adhesive films fill the microscopic surface irregularities on both the FPCB and the substrate to provide improved thermal transfer.

Figure 7C:
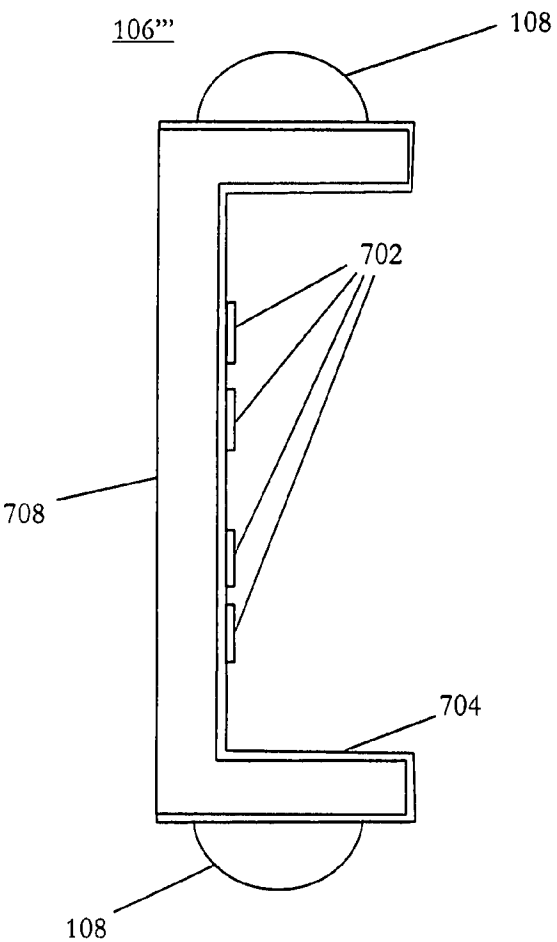
FIG. 7C is a top plan drawing of a further exemplary pixel module according to the present invention.
Figure 7B:
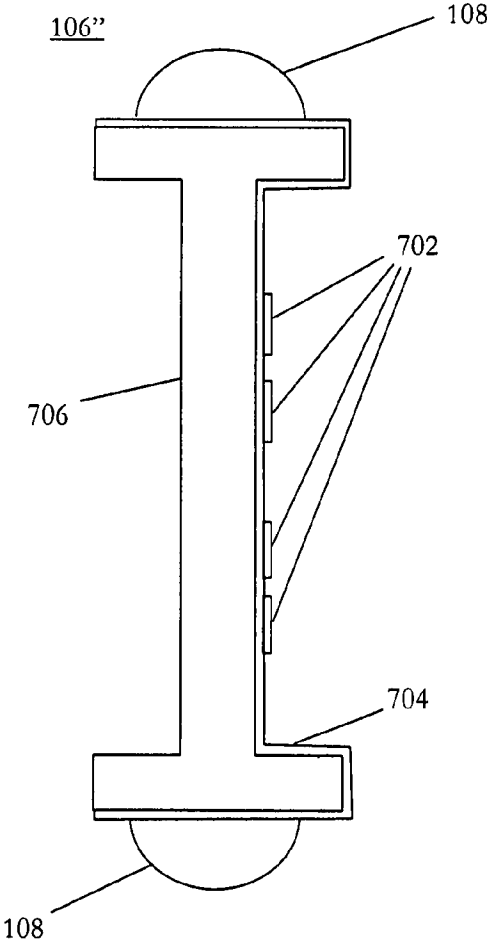
FIG. 7B is a top plan drawing of another exemplary pixel module according to the present invention.
Figure 7A:
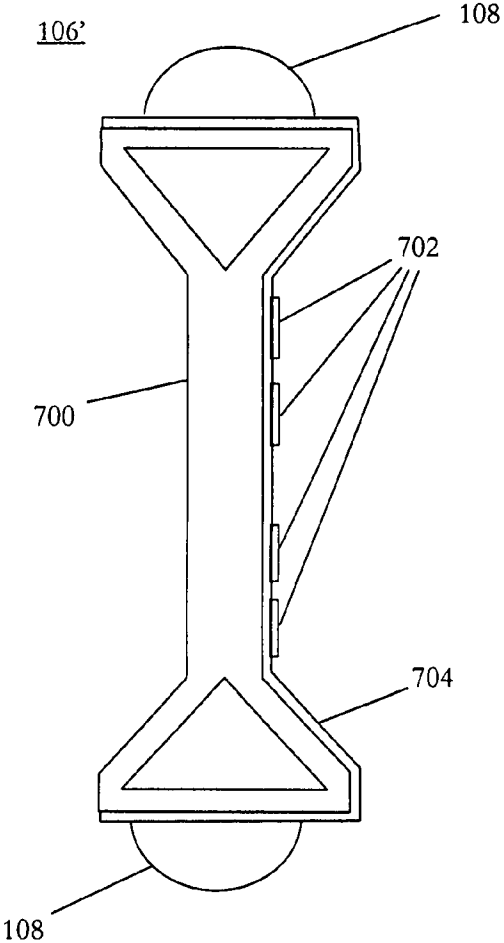
FIG. 7A is a top plan drawing of an exemplary pixel module according to the present invention.

In an exemplary two sided LED display, the substrate may desirably include: a front face; a back face that is substantially opposite the front face; and a side face that extends between the front and back faces and is substantially perpendicular to the front and back faces. FIGS. 7A-C illustrate three exemplary pixel modules that illustrate these features of the substrate. FIG. 7A illustrates exemplary pixel module 106' with dumbbell shaped substrate 700. FIG. 7B illustrates exemplary pixel module 106" with I-shaped substrate 706. FIG. 7C illustrates exemplary pixel module 106'" with bracket shaped substrate 708.

As shown in FIGS. 7A-C, FPCB 704 is desirably laminated on the front face, the back face, and the side face of the rigid, thermally conductive substrate. It is noted that the pixel control circuitry is shown as part of FPCB 704 in FIGS. 7A-C to improve the readability of these figures. Also shown in FIGS. 7A-C are four exemplary electrodes 702, which include the power electrode, the ground electrode, a bus electrode and a bus ground electrode. Electrode 702 are desirably mounted on a side portion of FPCB 704 corresponding to the side face of the substrate and two LED light sources 108 are mounted on front and back portions of FPCB 704 corresponding to the front and back faces of the substrate. In each of these figures, the front face and the back extend such that the side face is not visible to a viewer of the LED display. It is also noted that both electrodes 702 and the pixel control circuitry are desirably mounted on the side portion of the FPCB 704 and, thus, may be hidden from the viewer of the LED display in these exemplary embodiments.

The power electrode electrically couples to the power wire of the coupled cable to receive a portion of the drive current transmitted by the coupled cable, the ground electrode electrically couples to the ground wire of the coupled cable, and the bus electrode electrically couples to the data bus wire of the coupled cable to receive the portion of the control signal transmitted by the coupled cable when the pixel module is coupled to a cable.

Pixel modules 106 may desirably be formed in relatively thin bar shapes which straddle the four wires and have LED light sources 108 on their end faces, as shown in FIGS. 7A-C. In an exemplary embodiment of the present invention, the pixel modules may also include a coupling clamp to clamp pixel modules 106 to the tensioned wires of cables 104. FIG. 2B illustrates coupling clamp 204, which is adapted to allow pixel module 106 to be moveable along the length of the corresponding cable 106. Coupling clamp 204 is further adapted such that the power electrode may be brought into contact with the power wire of coupled cable 104, the ground electrode may be brought into contact with the ground wire of coupled cable 104, the bus electrode may be brought into contact with the data bus wire of coupled cable 104, and the bus ground electrode may be brought into contact with the bus ground wire of coupled cable 104 when pixel module 106 is clamped to the corresponding cable.

Exemplary coupling clamp 204 may desirably be an injection molded plastic clamping plate ("wire clamp"). This exemplary coupling clamp has two fastener holes and four half-round grooves to locate the wires. The substrate of pixel module 106 desirably has tapped holes matching the fastener holes of coupling clamp 204. The clamp is secured to the body of the pixel module by two screws and sandwiches the four wires to contacts on the various electrodes. These electrodes may desirably be rectangular conductive pads on the top layer of a circuit board. The electrodes may also desirably be hard gold plated for corrosion resistance and conductivity. Desirably the circuit board may be compliant so that the electrodes may conform at least somewhat to the shape of the wires and ensure both good electrical contact and mechanical clamping. This arrangement, may also allow for rapid assembly, movement, and replacement of the pixel modules on the cables. This coupling method also allows the construction of displays with any pixel pitch to be assembled easily, without specialized tooling or setup.

Exemplary LED display systems according to the present invention are designed to accommodate high output LED's. While LED's are generally considered efficient light sources, their true efficiency at converting electrical energy to light may be only about 25%. Most of the power used by LED's is dissipated as heat. Newer LED packages are considered "high power" because their thermally conductive design dissipates that excess heat to the ambient environment, permitting higher forward currents without damage to the die. These high output devices are currently manufactured by a number of companies, including Lumileds, Lamina Ceramics, and Cree. All of these companies produce LED packages that are surface mount devices and all suggest assembly on a circuit material with high thermal conductivity, typically a metal core printed circuit board. Use of higher power LED's in exemplary embodiment of the present invention is desirable, however, as this allows lower resolution exemplary displays to be visible in daylight.

LED light source(s) 108 of each pixel module may be formed of a single LED or an array of LED's and may include traditional inorganic LED's as well as organic LED's (OLED's). For example, LED light source(s) 108 may include a single wavelength LED or a multi-wavelength, 'white' LED device that includes a short wavelength LED and down conversion material(s) to provide longer wavelengths. Alternatively, a color LED source, such as exemplary RBG LED light source 108', may be used. As shown in FIG. 8, exemplary RBG LED light source 108' includes red LED 800, blue LED 802, and green LED 804.

The pixel control circuitry of each pixel module is electrically coupled to the power electrode, the ground electrode, the bus electrode, and the LED light source(s). The pixel control circuitry is adapted to drive the LED light source(s) with the drive current based on the portion of the control signal received from bus electrode. If the exemplary pixel module includes opposite facing LED light sources, the pixel control circuitry may adapted such that the two LED light sources emit light substantially synchronously, causing mirror images to be displayed on the two sides of the display. Alternatively, the pixel control circuitry may be adapted to independently control the opposite facing LED light sources.

The pixel control circuitry may include a number of electronic components and may desirably operate over a wide temperature range, e.g. −20 to 80 degrees C. For example, the various electronic components of the pixel control circuitry may include: a differential data transceiver; a microcontroller; a constant current LED driver; a voltage regulator; and a ceramic resonator.

The differential data transceiver translates differential serial bus data from the control processor to TTL voltage levels. An exemplary design may use an 8-pin RS485 device for half-duplex, bidirectional communication between the pixel modules and the control system. Alternative exemplary designs may use low voltage differential signaling technology (LVDS) or bus LVDS transceivers to reduce electromagnetic interference and increase data rates.

The microcontroller's function is to decode serial data and control the output intensity of the LED's. Exemplary criteria for the microcontroller may include: compact packaging (e.g. 20-QFN, 4×4 mm); flash program and data memory for storing operating constants; in system programmability; serial peripheral features; and low cost. One such microcontroller is an Atmel Attiny 2313 device.

The constant current LED driver regulates the current on the cathode (negative) terminal of the LED. The LED anode may be connected directly to the bus voltage (7.2V nominal). In this configuration, the constant current LED driver dissipates a considerable amount of heat and is desirably bonded to the FPCB during assembly using a thermally enhanced epoxy prior to reflow soldering. The microcontroller interfaces to this device with synchronous serial lines and controls the amount of time the LED light source(s) is on, thereby modulating their output intensity. An exemplary constant current LED driver is a Macroblock (Taiwan) MB15168 serial input, parallel output (SIPO) 8 bit low side driver. The LED current for each of the 8 outputs of this constant current LED driver may be set by a single external resistor.

The 5V bus powers the three logic devices on the board, which together may draw approximately 30 ma during normal operation. The voltage regulator may be used to regulate the voltage to these devices. The bulk of the board current is the LED forward current, which flows from the 7.2VDC drive current wire and is regulated by the LED drivers. This voltage regulator may be an On Semiconductor NCP563 5V LDO or another voltage regulator that is capable of outputting 80 ma.

The clock source for the circuit is desirably a ceramic resonator, which may be selected for its compact size, low cost and acceptable frequency tolerance and stability over a wide temperature range. One such ceramic resonator is an 8 MHz Murata ceramic resonator.

The use of differential data transmission is a commonly used arrangement in individually addressable LED display nodes, as differential serial buses allow large numbers of nodes on a single serial network. Each pixel module may be programmed with a unique serial number at the time of manufacturing and testing. When assembled on a cable, the control processor may initiate a discovery process to determine the number of modules and their unique ID's and locations within the display. This involves using a collision detection multiple sense access (CDMSA) style bus protocol between the pixel modules and the control processor. The control processor sends a command to illuminate each pixel based on its serial number. A digital video camera then relays the comparative position of the illuminated pixel back to the control processor so that a sorting algorithm may be used to assign X,Y coordinates to the pixels by serial number. This configuration process may be performed once when the display is built or installed and may be repeated if any modules are replaced for service. Once each pixel has its position assigned, image data may be streamed to the pixel module of the exemplary display matrix in packets.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A light emitting diode (LED) display, comprising:

drive circuitry to provide a drive current;

a control processor to provide a control signal;

a frame including a first edge and a second edge;

a plurality of cables extending rigidly from the first edge of the frame to the second edge of the frame, each cable including a power wire electrically coupled to the drive circuitry to transmit a portion of the drive current, a ground wire, and at least one data bus wire coupled to the control circuitry to transmit at least a portion of the control signal; and at least one pixel module coupled to each cable, each pixel module including:

a power electrode electrically coupled to the power wire of the coupled cable to receive a portion of the drive current transmitted by the coupled cable;

a ground electrode electrically coupled to the ground wire of the coupled cable;

a bus electrode electrically coupled to the data bus wire of the coupled cable to receive the portion of the control signal transmitted by the coupled cable;

an LED light source; and pixel control circuitry electrically coupled to the power electrode, the ground electrode, the bus electrode, and the LED light source, the pixel control circuitry adapted to drive the LED light source with the drive current based on the portion of the control signal received from bus electrode.

2. The LED display according to claim 1, wherein the control processor includes at least one of a general purpose computer, a digital signal processor, a digital video interface, special purpose video control circuitry, or an application specific integrated circuit.

3. The LED display according to claim 1, wherein the frame defines one of a planar display surface or a curved display surface.

4. The LED display according to claim 1, wherein the frame includes one of a transparent faceplate or translucent faceplate.

5. The LED display according to claim 1, wherein the frame includes one of a solid faceplate or a permeable faceplate.

6. The LED display according to claim 1, wherein at least one of the first edge or the second edge of the frame is curved.

7. The LED display according to claim 1, wherein the first edge of the frame is parallel to the second edge of the frame.

8. The LED display according to claim 1, wherein:

the frame further includes a third edge; and a further plurality of cables extend rigidly from the first edge of the frame to the third edge of the frame.

9. The LED display according to claim 1, wherein the plurality of cables are parallel.

10. The LED display according to claim 1, wherein the power wire, the ground wire, and the at least one data bus wire of each cable are at least three separate wires strung in parallel between the first edge of the frame and the second edge of the frame.

11. The LED display according to claim 1, wherein each cable further includes an electrically insulating ribbon to which the power wire, the ground wire, and the at least one data bus wire are mechanically coupled.

12. The LED display according to claim 1, wherein:

at least one of the power wire, the ground wire, or the at least one data bus wire of each cable is surrounded by an electrically insulating layer; and at least one corresponding power electrode, ground electrode, or data bus electrode of each pixel module is adapted to pierce the electrically insulating layer surrounding the at least one of the power wire, the ground wire, or the at least one data bus wire to which the pixel module is coupled.

13. The LED display according to claim 1, wherein a plurality of pixel modules are coupled to each cable at substantially equal spacings.

14. The LED display according to claim 1, wherein each pixel module further includes a coupling clamp, the coupling clamp being adapted such that the pixel module is moveable along a length of the corresponding cable.

15. The LED display according to claim 14, wherein the coupling clamp is further adapted such that the power electrode is brought into contact with the power wire of the coupled cable, the ground electrode is brought into contact with the ground wire of the coupled cable and the bus electrode is brought into contact with the data bus wire of the coupled cable when the pixel module is coupled to the corresponding cable.

16. The LED display according to claim 1, wherein the LED light source of each pixel module is a white LED.

17. The LED display according to claim 1, wherein the LED light source of each pixel module includes a red LED, a blue LED, and a green LED.

18. The LED display according to claim 1, wherein each pixel module further includes an other LED light source arranged to emit light in a direction substantially opposite to a direction that the LED light source emits light.

19. The LED display according to claim 18, wherein the pixel control circuitry of each pixel module is adapted such that the LED light source and the other LED light source emit light substantially synchronously.

20. The LED display according to claim 18, wherein each pixel module further includes:

a rigid, thermally conductive substrate having a front face, a back face substantially opposite the front face, and a side face substantially perpendicular to the front face and the back face and extending between the front face and the back face; and a flexible printed circuit board (FPCB) laminated on the front face, the back face, and the side face of the rigid, thermally conductive substrate such that the FPCB is thermally and mechanically coupled to the rigid, thermally conductive substrate and the FPCB is not electrically coupled to the rigid, thermally conductive substrate;

wherein:

the pixel control circuitry is mounted on the FPCB;

the power electrode, the ground electrode, and the bus electrode are mounted on a side portion of the FPCB corresponding to the side face of the rigid, thermally conductive substrate;

the LED light source is mounted on a front portion of the FPCB corresponding to the front face of the rigid, thermally conductive substrate; and the other LED light source is mounted on a back portion of the FPCB corresponding to the back face of the rigid, thermally conductive substrate.

21. The LED display according to claim 20, wherein the front face and the back face of the rigid, thermally conductive substrate of each pixel module extend such that the side face is not visible to a viewer of the LED display.

22. A light emitting diode (LED) display, comprising:

drive circuitry to provide a drive current;

a control processor to provide a control signal;

a curved frame including an edge;

a plurality of cables, each cable extending rigidly from one location on the edge of the curved frame to another location of the edge of the curved frame and including:

a power wire electrically coupled to the drive circuitry to transmit a portion of the drive current;

a ground wire; and at least one data bus wire coupled to the control circuitry to transmit at least a portion of the control signal; and at least one pixel module moveably coupled to each cable, each pixel module including:

a power electrode electrically coupled to the power wire of the coupled cable to receive a portion of the drive current transmitted by the coupled cable;

a ground electrode electrically coupled to the ground wire of the coupled cable;

a bus electrode electrically coupled to the data bus wire of the coupled cable to receive the portion of the control signal transmitted by the coupled cable;

an LED light source; and pixel control circuitry electrically coupled to the power electrode, the ground electrode, the bus electrode, and the LED light source, the pixel control circuitry adapted to drive the LED light source with the drive current based on the portion of the control signal received from bus electrode.

23. The LED display according to claim 22, wherein the frame surrounds and defines a planar display surface.

24. The LED display according to claim 22, wherein the frame surrounds and defines a curved display surface.

25. The LED display according to claim 22, wherein the edge of the curved frame is a closed curve.

26. The LED display according to claim 22, wherein the plurality of cables are parallel.

27. A pixel module for a two sided light emitting diode (LED) display, comprising:

a rigid, thermally conductive substrate having a front face, a back face substantially opposite the front face, and a side face substantially perpendicular to the front face and the back face and extending between the front face and the back face;

a flexible printed circuit board (FPCB) laminated on the front face, the back face, and the side face of the rigid, thermally conductive substrate such that the FPCB is thermally and mechanically coupled to the rigid, thermally conductive substrate and the FPCB is not electrically coupled to the rigid, thermally conductive substrate;

a power electrode mounted on a side portion of the FPCB corresponding to the side face of the rigid, thermally conductive substrate, the power electrode adapted to receive a drive current;

a ground electrode mounted on the side portion of the FPCB;

a bus electrode mounted on the side portion of the FPCB, the bus electrode adapted to receive a control signal;

a first LED light source mounted on a front portion of the FPCB corresponding to the front face of the rigid, thermally conductive substrate;

a second LED light source mounted on a back portion of the FPCB corresponding to the back face of the rigid, thermally conductive substrate; and pixel control circuitry mounted on the FPCB, the pixel control circuitry electrically coupled to the power electrode, the ground electrode, the bus electrode, the first LED light source, and the second LED light source, and adapted to drive the first LED light source and the second LED light source with the drive current based on the control signal received from bus electrode.

28. The pixel module according to claim 27, wherein the rigid, thermally conductive substrate is formed of at least one of aluminum, brass, bronze, or copper.

29. The pixel module according to claim 27, wherein the front face and the back face of the rigid, thermally conductive substrate of each pixel module extend such that the side face is not visible to a viewer of the LED display.

30. The pixel module according to claim 29, wherein a cross-section of the rigid, thermally conductive substrate in a plane perpendicular to the front face, the back face, and the side face is one of an I-shape, a dumbbell shape, or a bracket shape.

31. The pixel module according to claim 27, further comprising a coupling clamp adapted to moveably couple the pixel module to a cable.

32. The pixel module according to claim 31, wherein the coupling clamp is further adapted such that the power electrode is brought into contact with a power wire of the cable, the ground electrode is brought into contact with a ground wire of the cable and the bus electrode is brought into contact with a data bus wire of the cable when the pixel module is coupled to the cable by the coupling clamp.

33. The pixel module according to claim 27, wherein the first LED light source and the second LED light source are white LED's.

34. The LED display according to claim 27, wherein the first LED light source and the second LED light source each includes a red LED, a blue LED, and a green LED.

35. The pixel module according to claim 27, wherein the pixel control circuitry of each pixel module is adapted such that the first LED light source and the second LED light source emit light substantially synchronously.

* * * * *